United States Patent [19]

Menke

[11] Patent Number: 4,887,938

[45] Date of Patent: Dec. 19, 1989

[54] CONTROLLABLE LOCKING APPARATUS FOR IMPLEMENT CARRYING WORK VEHICLE

[75] Inventor: Jeffery W. Menke, Peoria, Ill.

[73] Assignee: Caterpillar Inc., Peoria, Ill.

[21] Appl. No.: 227,205

[22] Filed: Aug. 1, 1988

[51] Int. Cl.[4] ..... B66F 9/00; E02F 3/32

[52] U.S. Cl. ..... 414/694; 414/687

[58] Field of Search ..... 414/694, 690, 686, 687, 414/688, 685, 680

[56] References Cited

U.S. PATENT DOCUMENTS

| | | | |
|---|---|---|---|
| 3,811,582 | 5/1974 | Shumaker et al. | 214/138 |
| 3,921,835 | 11/1975 | Baker et al. | 214/138 R |
| 4,147,442 | 4/1979 | Bridwell et al. | 403/4 |
| 4,184,803 | 1/1980 | Housman | 414/694 |
| 4,225,282 | 9/1980 | Nordstrom et al. | 414/694 |
| 4,227,852 | 10/1980 | Schmitz et al. | 414/694 |
| 4,260,321 | 4/1981 | Beauchamp et al. | 414/694 |
| 4,273,502 | 6/1981 | Maurer et al. | 414/694 |
| 4,278,394 | 7/1981 | Johnson | 414/694 |
| 4,304,520 | 12/1981 | Schmitz | 414/694 |
| 4,370,090 | 1/1983 | Shumaker et al. | 414/694 |
| 4,636,132 | 1/1987 | Menke et al. | 414/694 |

*Primary Examiner*—Frank E. Werner
*Assistant Examiner*—James T. Eller, Jr.
*Attorney, Agent, or Firm*—J. W. Blumenshine

[57] ABSTRACT

On a work vehicle having a support, an implement carrying swing frame connected to the support by a first pivot pin apparatus, and an elevatable boom connected to the swing frame by a second pivot pin apparatus, a controllable locking apparatus having a boom lock for locking the boom in a substantially vertical position and maintaining the boom against movement, a swing lock for locking the swing frame against side to side movement, and an obstruction for preventing the swing frame from being locked against side to side movement unless the boom is locked against movement, is provided.

7 Claims, 4 Drawing Sheets

52
60
46
58
48
10
50
44
68
43
99
32
38
40
12
84
90
42
78
96
88
22
20
24
22
26
36
28
34
14
18
16
30
22
20
56
54

CONTROLLABLE LOCKING APPARATUS FOR IMPLEMENT CARRYING WORK VEHICLE

DESCRIPTION

1. Technical Field

This invention relates generally to vehicles which carry a boom that is swingable from side to side and which have a boom lock for locking the boom in a substantially vertical position, a swing lock for locking the boom from swinging from side to side, and a means for preventing the swing lock from being in a locked mode while the boom lock is in an unlocked mode.

2. Background Art

A conventional backhoe mounted on a work vehicle has an articulated boom that is pivotally mounted for vertical swinging movement about a horizontal pivot means carried on a swing frame, the swing frame being pivotally mounted for horizontal swinging movement about a vertical pivot means coupled to a frame support of the work vehicle. The raising and lowering movement of the boom and the side swinging movement of the swing frame, and thereby of the boom, are actuated by hydraulic rams or cylinder mechanisms. Conventionally, during transport of the work vehicle from one place to another, either under its own power or on a flatbed truck, the boom is hydraulically raised to prevent the earth digging bucket mounted on the free end of the boom from dragging on the ground. The swing frame, and thereby the boom, are centered relative to the frame structure of the work vehicle to avoid increasing the effective width of the work vehicle or overhanging the sides of the flatbed truck on which the vehicle is being carried.

It has been found, however, that sometimes, because of internal hydraulic oil leakage in the hydraulic position rams, particularly in older vehicles, the boom has a tendency to droop causing the bucket to drag on the ground or to drag on the truck bed or loading ramps as the vehicle is being moved on or off the truck bed.

Also, for the same reasons, the swing frame has a tendency to permit the boom and its bucket to swing from side to side as the work vehicle is driven down the road or is carried on the flatbed truck. This side to side swaying effect of the swing frame and the boom, if permitted to attain any degree of magnitude, can result in steering instability of the work vehicle or of the transporting vehicle. Further, the effective width of the vehicle may be increased without the operator realizing it, thereby increasing the chances of hitting something with the bucket.

A number of references exist which are directed to solving the above two described problems. Devices limited to locking the boom in a raised position are disclosed in U.S. Pat. No. 3,811,582 issued May 21, 1974 to Shumaker et al. for a "Backhoe Boom Lock"; U.S. Pat. No. 3,921,835 issued Nov. 25, 1975 to Baker et al. for a "Releasable Lock Means for Boom"; U.S. Pat. No. 3,995,761 issued Dec. 7, 1976 to Hurlburt for "Anti Lowering Device for a Boom Loader"; U.S. Pat. No. 4,184,803 issued Jan. 22, 1980 to Housman for a "Releasable Backhoe Boom Lock"; U.S. Pat. No. 4,227,852 issued Oct. 14, 1980 to Schmitz et al. for a "Releasable Backhoe Boom Lock"; and U.S. Pat. No. 4,273,502 issued June 16, 1981 to Maurer et al. for a "Boom Lock Means". Obviously, these devices do not solve the second above mentioned problem of the swing frame swaying.

Devices which lock the boom and the swing frame both are disclosed in U.S. Pat. No. 4,225,282 issued on Sept. 30, 1980 to Nordstrom et al. for a "Backhoe Boom Transport Locking Means"; U.S. Pat. No. 4,260,321 issued Apr. 7, 1981 to Beauchamp et al. for a "Lock Mechanism For Securing a Backhoe Boom and Swing Frame for Transport"; U.S. Pat. No. 4,370,090 issued Jan. 25, 1983 to Shumaker et al. for a "Boom Lock"; and U.S. Pat. No. 4,636,132 issued Jan. 13, 1987 to Menke et al. for a "Vehicle Boom Lock". Of the four just referenced devices, only the Menke et al. device permits the boom to be locked in an upright position without the swing frame being locked. The other three devices all operate in such a way that the swing frame is simultaneously locked from swaying when the boom is locked into an upright position. Often, such an arrangement can be advantageous because such a device requires only one manipulation by the operator in order to completely lock up the backhoe. However, it is also advantageous at times to be able to lock the boom in an upright position while still being able to swing the swing frame from side to side. For instance, when the vehicle is moving along a sidehill, the boom can be locked up while the swing can be controlled in order to provide a safe sidehill counterbalance to the weight of the vehicle and gravity. Also, when the boom is being used for stick craning the boom can be locked up, thereby improving the stability of the boom and stick and allowing for improved controllability of the swing.

The present invention is directed to an improvement to those devices, like the Menke et al. device, which allow independent locking of the boom and swing frame. A problem with such devices heretofore not realized or, if realized, heretofore not resolved, is that when the swing frame is locked and the boom is unlocked and extended, if the operator tries to swing the swing frame without realizing that it is in the locked position, the swing frame or mounting support casting may break. There is a much lesser and practically nil probability of the castings breaking when the boom is locked in an upright position because even if the operator tries to swing the swing frame while it is locked, not enough inertia will be created to break the castings. However, as the boom and bucket are extended, especially if the bucket is loaded, the moment of inertia (mass times radius squared) increases to a degree which may be enough to break the castings. This is especially a problem on the modern large backhoes which have very long booms and extremely heavy buckets. It is obvious that much time and money can be lost if a casting breaks, not only due to the repair of the vehicle but also due to the delay in completing the project. Thus, there exists a very real need for a device which will prevent the boom from being extended while the swing frame is locked.

Therefore, on a work vehicle which carries a boom that is swingable from side to side and which has a boom lock for locking the boom in a substantially vertical position and an independent swing lock for locking the swing frame and boom from swinging from side to side, it is an object of the present invention to provide a means for preventing the boom from being able to extend while the swing frame is locked.

DISCLOSURE OF THE INVENTION

In accordance with the present invention, on a work vehicle having a support, an implement carrying swing frame connected to the support by a first pivot pin apparatus, and an elevatable boom connected to the swing frame by a second pivot pin apparatus, a controllable locking apparatus having a means for locking the boom in a substantially vertical position and maintaining the boom against movement, a means for locking the swing frame against side to side movement, and a means for preventing the swing frame from being locked against side to side movement unless the boom is locked against movement, is provided.

In a preferred embodiment, the boom locking means is a boom lock having a first locking member affixed to the swing frame and a second locking member affixed to the boom, the locking members being engageable for locking and maintaining the boom in a substantially vertical position. Also, in a preferred embodiment, the swing locking means is a pin and openings in the swing frame and support wherein the pin can be inserted into the openings and maintain the swing frame against movement. Also in a preferred embodiment, the means for preventing the swing frame from being locked unless the boom is locked is an obstruction that is responsive to movement of the first locking member of the boom lock such that the obstruction obstructs the openings of the swing lock when the boom lock is unlocked so that the pin cannot be inserted and the swing frame cannot be locked but is spaced from the openings when the boom lock is locked so that the pin can be inserted and the swing frame can be locked.

BEST MODE FOR CARRYING OUT THE INVENTION

The present invention relates to work vehicles having an extendable boom that is swingable from side to side and which have a boom lock which locks the boom in a substantially upright position and a swing lock which locks the boom from swinging from side to side, wherein the two locking devices are independent of each other such that without the benefit of the present invention the boom could be in an extended position while being locked from side to side swinging.

Figure 1:
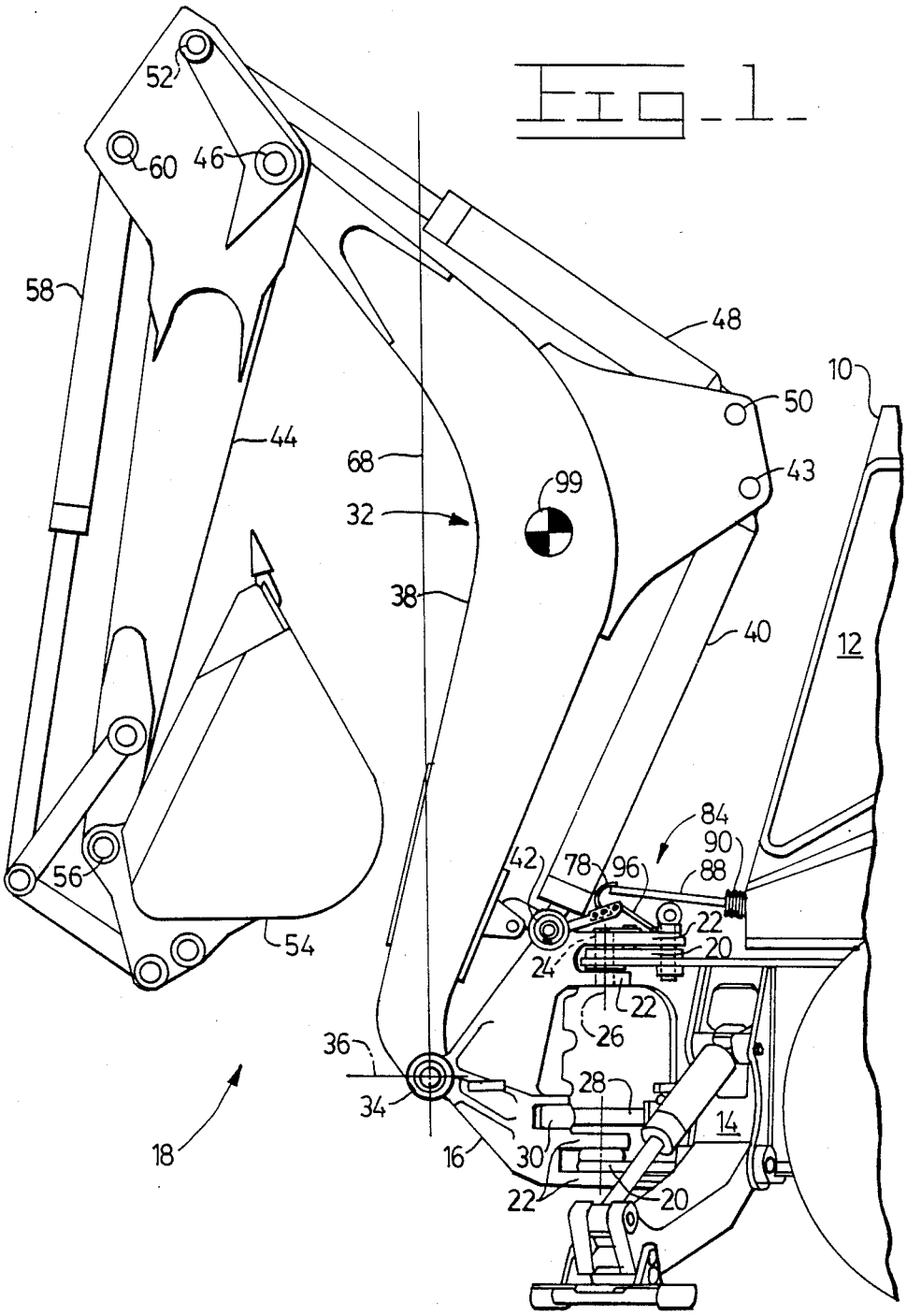
FIG. 1 is a diagrammatic, side elevational view of a rear portion of a backhoe type work vehicle incorporating a controllable locking apparatus in accordance with a preferred embodiment of the present invention and showing the boom in a retracted position with the controllable locking apparatus in a first position securely maintaining the boom in the retracted position.

Referring now to the drawings, and more particularly to FIG. 1, there is partially shown one end of a work vehicle, generally designated 10, having an operator's station 12, a support or main frame 14, a swing frame 16 pivotally connected to the rear of the support 14, and a work implement or backhoe mechanism 18 pivotally connected to the swing frame 16. The support 14 includes a pair of rearwardly extending plate members 20 which are suitably interleaved with a plurality of forwardly extending plate members 22 on the swing frame 16. These respective plate members are pivotally connected together by a first pivot pin apparatus 24 having an upright or substantially vertical axis 26. A pair of telescoping hydraulic rams or jacks 28 extend from the support 14 to a coupling joint 30 located at either side of the swing frame 16 for adjusting the angular disposition of the backhoe mechanism 18 relative to the longitudinal axis of the vehicle 10.

The backhoe mechanism 18 includes a boom assembly 32 which is elevatably mounted on the swing frame 16 by a second pivot pin apparatus 34 defining a generally horizontal axis 36. The boom assembly 32 has a boom 38, and a hydraulic ram or jack 40 which extends upwardly from pivot joint 42 on the swing frame 16 to pivot joint 43 on the boom 38 for lowering the boom 38 about the axis 36 from an upright position to the desired working angle.

A stick assembly 44 is pivotally connected to the upper end of the boom assembly 32 at a pivot joint 46, and a hydraulic ram or jack 48 extends from a coupling joint 50 on the front inside surface of the boom 38 to a front coupling joint 52 on the stick assembly for manipulating it through the desired working angles in the usual manner. A backhoe bucket 54 is pivoted at 56 on the other end of the stick assembly 44 by another ram or jack 58 pivotally interconnected between a joint 60 on the stick assembly 44 and a joint 62 on an arm 64 extending from the rear of the back face part of the bucket 54.

It is to be understood that the physical disposition of the swing frame 16, the boom 38, the stick assembly 44 and the backhoe bucket 54 are determined by supplying pressurized hydraulic fluid to the respective rams 28, 40, 48 and 58 in a conventional manner.

Figure 2:
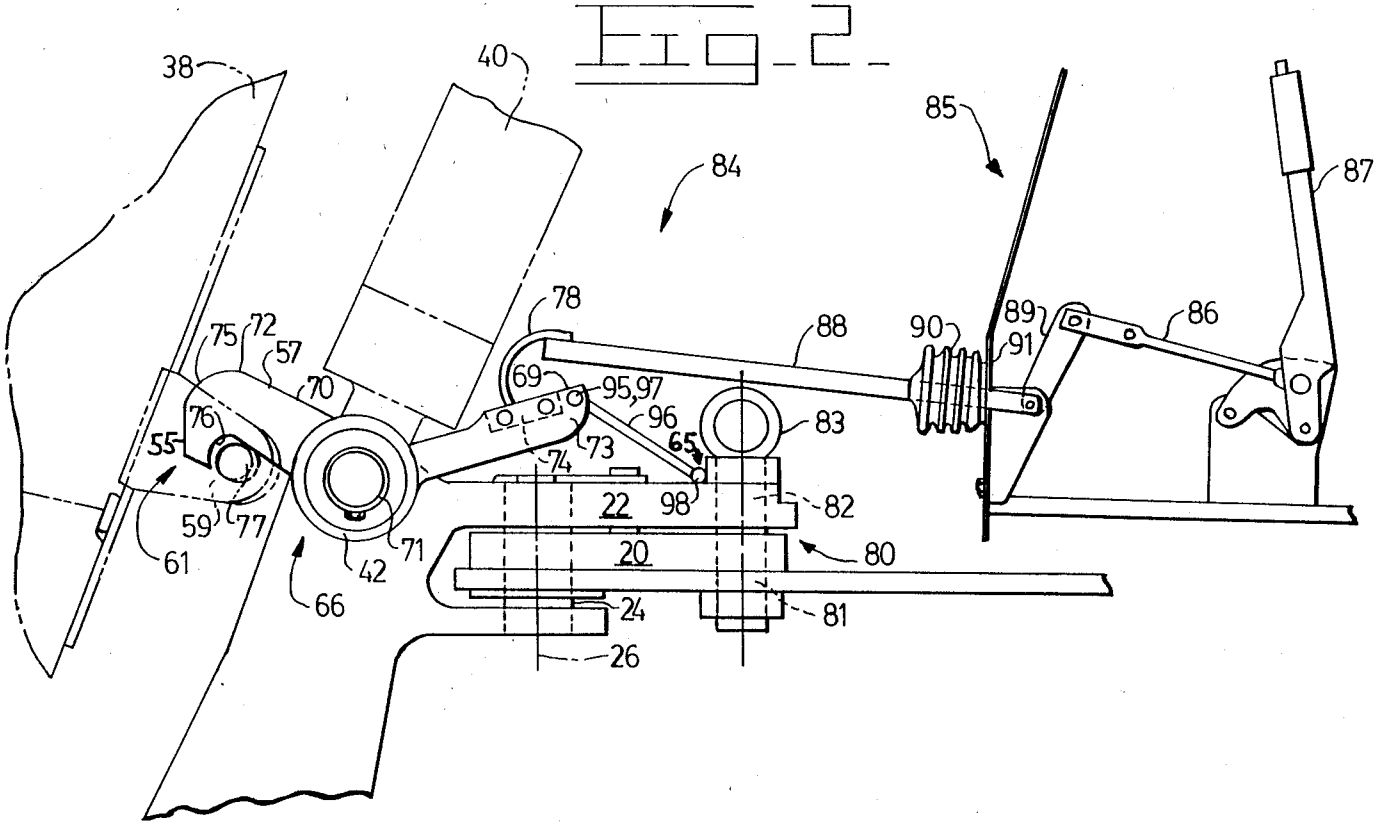
FIG. 2 is a partial, diagrammatic, side elevational view of the controllable locking apparatus region illustrated in FIG. 1, the controllable locking apparatus being in the first position and including a boom lock, a swing lock, a means for preventing the boom from being in an extended position when the swing frame is locked and a manipulator assembly.
Figure 3:
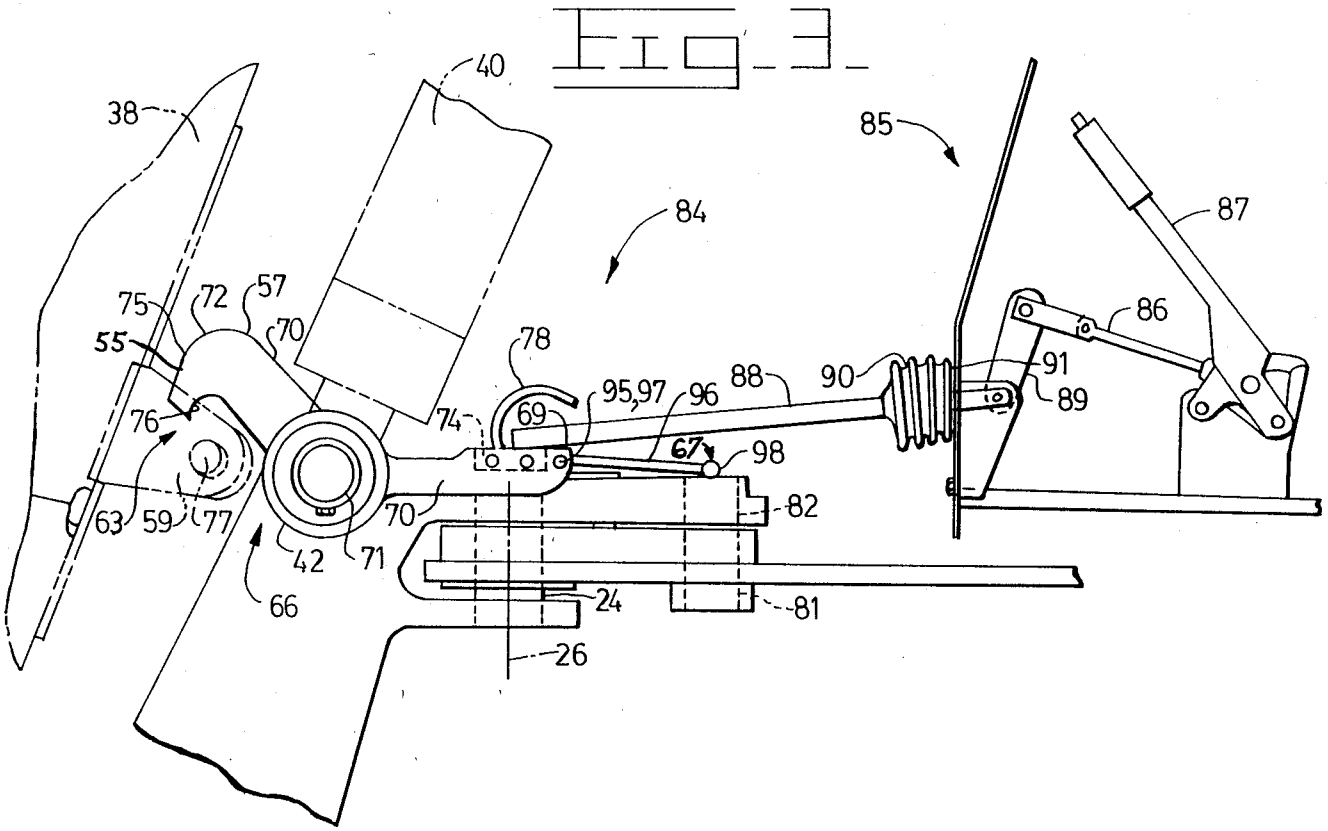
FIG. 3 is a view of the controllable locking apparatus similar to FIG. 2 only showing the controllable locking apparatus in a second unlocked position.
Figure 4:
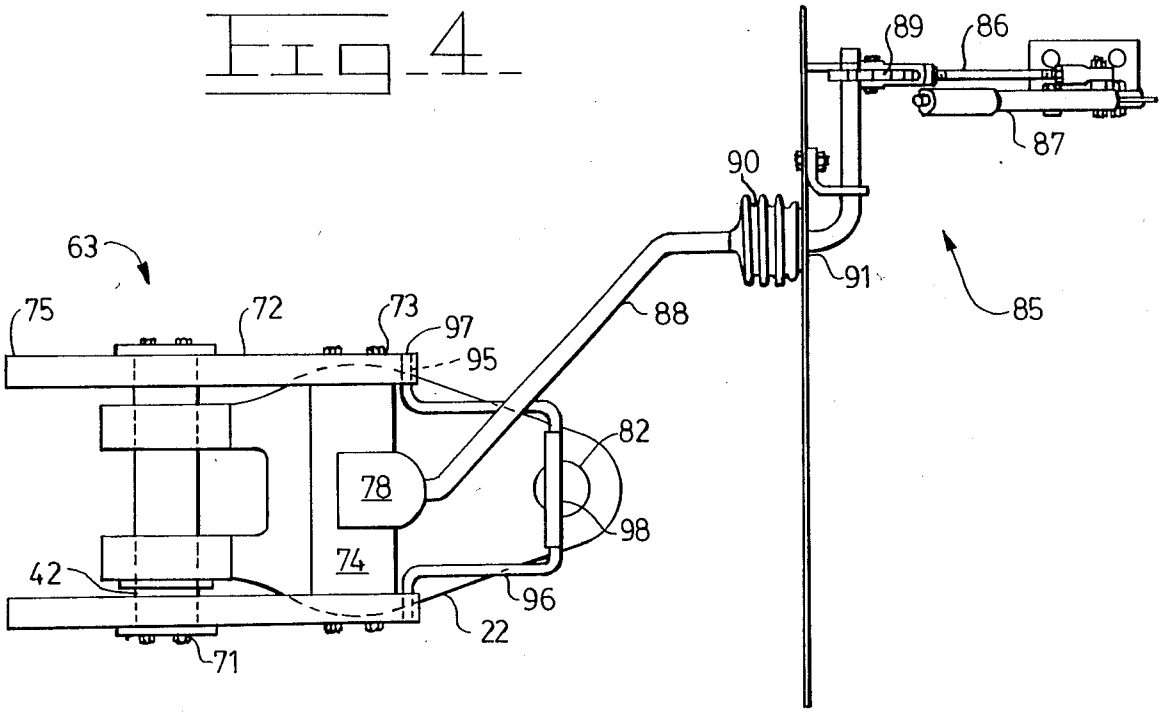
FIG. 4 is a partial, diagrammatic, top view of the controllable locking apparatus in the second unlocked position as shown in FIG. 3.

Now with reference to FIGS. 2, 3, and 4 the controllable locking apparatus 84 of the present invention will be described. The controllable locking apparatus 84 includes a means, such as a boom lock 66, for locking the boom 38 in a substantially vertical position and maintaining the boom 38 against movement, a means, such as a swing lock 80, for locking the swing frame against side to side movement and a means for preventing the swing frame 16 from being locked unless the boom 38 is locked. In accordance with a preferred embodiment of the present invention, a boom lock 66 is provided for positively maintaining the boom assembly in a retracted position. Basically, the boom lock 66 includes a first locking member 57 affixed to the swing frame 16 and a second locking member 59 affixed to the boom 38.

In the preferred embodiment illustrated and described, the first locking member 57 is affixed to the swing frame 16. The first locking member 57 is affixed to the swing frame 16 in this embodiment so that the first locking member 57 will swing in conjunction with the swing frame 16 and the boom 38 can therefore be locked in any swing position of the swing frame 16. However, embodiments in which the first locking member 57 is affixed to the support 14 while still being swingable so as to be engageable with the second locking member 59 at a plurality of swing positions are imaginable. Therefore, it is understood that the term "first locking member affixed to said swing frame" is intended to include embodiments wherein the first locking member 57 is affixed to the swing frame 16 and embodiments wherein the first locking member 57 is affixed to the support 14 yet is swingable so as to be engageable with the second locking member 59 at a plurality of swing positions.

The boom lock 66 is preferably configured in such a manner that when the boom 38 is locked up the center of gravity 99 of the backhoe mechanism 18 will be disposed in an over-center disposition forwardly or inwardly of a vertical plane 68 through the axis 36 of the second pivot pin apparatus 34, as is diagrammatically illustrated in FIG. 1. In a preferred embodiment, as shown, the first locking member 57 is an elongated lever 70 which is fulcrummed between its ends 55,69 on the elongated pivot pin 71 of the pivot joint 42. The lever 70 is of bifurcated construction and has spaced side arms 72 that are joined near their first ends 73 closest to the support 14 by a brace 74. The second end 55 of the lever 70, which in the preferred embodiment illustrated is also the second ends 75 of the side arms 72, have downwardly turned hooks 76 which are adapted to engage the second locking member 59, which is affixed to the boom 38. In the preferred embodiment illustrated, the second locking member 59 includes a pair of laterally extending pins 77 which are securely affixed to the boom 38 and which are spaced apart a distance determined in accordance with the distance between the hooks 76 of the lever 70. The hooks 76 and pins 77 are configured in such a manner that when engaged, they will securely hold the boom 38 in a substantially vertical position. The locking members 57 and 59 are controllably moveable between a first position 61, as shown in FIGS. 1 and 2, at which the boom 38 is in a substantially vertical position and the locking members 57 and 59 are engaged and maintaining the boom 38 against movement and a second position 63, as shown in FIG. 3, at which the locking members 57 and 59 are disengaged and the boom 38 is free for movement.

Affixed to the top surface of the brace 74 is an arched plate 78. The arched plate 78 is provided and configured to receive a second bar 88 of a manipulator assembly 85, as later described. The plate 78 is arched as opposed to angled so that the second bar 88 will ride smoothly on its inner surface during the transition from the first position 61 to the second position 63. The plate 78 is left open on its sides and front so that it is accessible by the second bar 88 at all swing positions, thereby allowing the boom 38 to be locked up at all swing positions. The first locking member 57 is balanced in such a manner that it will remain in the second position 63 with the hooks 76 in a raised position unless it is manipulated into the first position 61.

The first locking member 57 is controllably moveable between the first and second positions 61 and 63 by a manipulator assembly 85. The manipulator assembly 85 allows the operator to manipulate the first locking member 57 from a remote location, preferably inside the operator's cab 12. As shown in FIGS. 2, 3, and 4, the manipulator assembly 85 includes a hand lever 87 which is connected to a first bar 86 which is connected by a fixed link 89 to a second bar 88. The second bar 88 projects through a sealing boot 90 covering an aperture 91 in the front wall of the operator's cab. The second bar 88 is operatively associated with the first end 69 (in the preferred embodiment illustrated the arched plate 78 and the brace 74) of the lever 70 such that a pull force applied by the operator to the hand lever 87 results in the second bar 88 moving upward which in turn moves the first locking member 57 from the first position 61 to the second position 63, or vice versa if the hand lever 87 is pushed down. The second locking member 59 is affixed to the boom 38 and is, therefore, moveable along with the boom 38 by the hydraulic jack 40.

Also in accordance with a preferred embodiment of the present invention, a swing lock 80 is provided for maintaining the swing frame 16 in a stationary and locked position. As shown in FIGS. 2 and 3, the swing lock 80 includes an opening or bore 82 formed in the plate member 22 of the swing frame 16. The swing lock 80 also includes an opening 81 formed in the plate member 20 of the support 14. The swing lock 80 also includes a pin 83 which can be manually inserted into the openings 81 and 82 when the openings are appropriately aligned by centering the swing frame 16 symmetrically on the central longitudinal axis of the vehicle 10 by proper manipulation of the rams 28. If the operator tries to swing the swing frame 16 while the pin 83 is properly inserted, the pin 83 will make contact with the interior surfaces of the openings 81 and 82 and substantially prevent movement of the swing frame 16. The swing lock 80 can alternatively be configured so as to be lockable at a preselected location or locations anywhere along the swing path. The pin 83 can be a pin, screw, bolt or any similar mean.

Also, in accordance with a preferred embodiment of the present invention, a means for preventing the first locking member 57 from being at a position other than the first position 61 while the swing lock 80 is locked, is provided. As shown in FIG. 4, affixed to the first locking member 57 is a means for obstructing the insertion of the pin 83 into the opening 82 of the swing frame 16. The obstruction means is responsive to the movement of the first locking member 57 and is positioned in accordance with the positioning of the first locking member 57. When the first locking member 57 is at the first position 61, the obstruction means is at a first position 65 spaced from the opening 82 and the pin 83 is able to be inserted into the opening 82. When the first locking member 57 is at the second position 63, or a position other than the first position 61, the obstruction means is at a second position 67 and covers a portion of the opening 82 and obstructs insertion of the pin 83 into the opening 82, thus preventing the swing frame 16 from being locked while the boom 38 is in an extended position.

In accordance with a preferred embodiment of the present invention, a horizontal hole 95 is formed in each arm 72 of the lever 70 near their ends 73. The ends 97 of a rod 96 are inserted into the holes 95, as shown in FIG. 4. The forward extension 98 of the rod 96 is the obstruction means. The rod 96 is freely swingable in the holes 95. As seen in FIG. 3, the rod 96 lies substantially horizontal when the first locking member 61 is in the second position 63 and the forward extension 98 of the rod 96 obstructs the opening 82 so as to prevent the pin 83 from being inserted therein. When the first locking member 57 is manipulated to the first position 61 as shown in FIG. 2, the ends 97 of the rod 96 are raised up along with the first end 69 of the lever 70 but because the rod 96 is freely swingable in the holes 95 the forward extension 98 of the rod 96 stays in contact with the swing frame 16 while sliding to a position spaced from the opening 82. Thus, the boom 38 is now locked up and the pin 83 can be inserted into the openings 81 and 82 so as to lock the swing lock 80. In alternative embodiments, the obstruction means might be a solid plate or it may be affixed to the second bar 88 instead of the first locking member 57, or in the embodiment illustrated, the lever 70. Such details are not necessarily critical. However, what is critical is that the obstruction means obstruct the opening 82 when the locking members 57 and 59 are in the second position 63 or a position other than the first position 61, thereby preventing the swing frame 16 from being locked while the boom 38 is in an extended position, and then move to a position spaced from the opening 82 when the locking members 57 and 59 are in the first position 61, thereby allowing the swing frame 16 to be locked.

INDUSTRIAL APPLICABILITY

The operation of the controllable locking apparatus 84 is as follows. Assume the boom lock 66 and the swing lock 80 are in their unlocked modes (i.e., the second position 63) and the boom 38 is extended, as shown in FIG. 3. Under this condition, as best shown in FIG. 4 the forward extension 98 of the rod 96 is positioned over the opening 82 and obstructs the pin 83 from being placed therein. This is the first mode of protection provided by the controllable locking apparatus 84.

Now assume that the boom 38 is retracted and the boom lock 66 is manipulated by the operator into the first position 61, or in other words, the locked mode. Under this condition, the forward extension 98 of the rod 96 is pulled just clear of the opening 82, thereby allowing insertion of the pin 83 and locking of the swing frame 16.

Now, assume that the operator unadvisably tries to unlock the boom 38 by attempting to manipulate the boom lock 66 into the unlocked mode while the swing frame 16 is locked. He will be prevented from doing so by the controllable locking apparatus 84. By way of explanation, as seen in FIG. 2, the pin 83 protrudes somewhat above the top surface of the swing frame 16. The forward extension 98 of the rod 96, which is adjacent to and rides on the top surface of the swing frame 16, is in contact with or nearly in contact with the pin 83. When the operator releases the hand lever 87 into its unlocked position, the second bar 88 tries to push the first end 69 of the lever 70 down and cause the lever 70 to pivot about the pivot pin 71, thereby releasing the hooks 76 from the pins 77. The way that the lever 70 is balanced, as previously described, also contributes in trying to move the lever 70 into the second position 63. However, as the lever 70 tries to move into the second position 63, the forward extension 98 of the rod 96 becomes positively engaged in intimate contact with the pin 83. If the rod 96 is properly sized and positioned, intimate contact will be achieved while the hooks 76 are still securely fastened to the pins 77. When intimate contact is achieved, the first end 69 of the lever 70 is prevented from lowering any further and the hooks 76 are prevented from releasing the pins 77. Thus, the boom 38 is prevented from being released into an extendable position while the swing frame 16 is in a locked mode. This is the second mode of protection provided by the controllable locking apparatus 84.

As an added precaution, a means is provided for preventing the obstruction means, or in this embodiment the forward extension of the rod 96, from being raised to a position above the top surface of the lever 70. Such a means prevents an operator from unadvisably manually lifting the forward extension 98 of the rod 96 up while the boom is in an extended position and then inserting the pin 83 into the opening 81. A preferred means is to extend the brace 74 out over a portion of the rod 96 so as to prevent the rod 96 from being lifted up above the top surface of the lever 70.

It is thus apparent that the controllable locking apparatus 84 is simple, rugged, reliable and of low cost. While only one embodiment of the present invention has been illustrated and described, it would be obvious to those skilled in the art that various other changes and modifications can be made without departing from the spirit and scope of the present invention. Given a certain boom lock and swing lock configuration, a workable and effective means for preventing the swing frame from being locked unless the boom is locked would be readily apparent to the skilled artisan. It is, therefore, intended to cover in the appended claims all such changes and modifications that are within the scope of this invention.

Other aspects, objects and advantages will become apparent from a study of the specification, drawings and appended claims.

I claim:

1. A controllable locking apparatus for a work vehicle having a support, an implement carrying swing frame connected to said support by a first pivot pin apparatus, and an elevatable boom connected to said swing frame by a second pivot pin apparatus, comprising:

a boom lock for locking said boom in a substantially vertical position and maintaining said boom against movement, said boom lock having a first locking member affixed to said swing frame and a second locking member affixed to said boom, said locking members being controllably moveable between a first position at which the boom is in a substantially vertical position and the locking members are engaged and maintaining said boom against movement and a second position at which said locking members are disengaged and said boom is free for movement;

a swing lock for locking said swing frame against side to side movement, said swing lock having a pin, an opening in said swing frame and an opening in said support, said openings being aligned with one another at a preselected location of said swing frame and said pin being insertable into said openings and maintaining said swing frame against movement; and a means for obstructing insertion of said pin in said openings at said second position of said locking members, said obstruction means being moveable in response to the movement of said first locking member between a first position at which said obstruction means is spaced from said openings at said first position of said locking members allowing insertion of said pin into said openings and a second position at which said obstruction means is covering said openings and obstructing insertion of said pin in said openings at the said position of said locking members.

2. The controllable locking apparatus of claim 1, including a manipulable means for moving said first locking member between said first position and said second position, said manipulate means being controllably manipulable from an operator's station at a location on said vehicle remote to said boom lock.

3. The controllable locking apparatus of claim 2, wherein said first locking member is a lever fulcrummed between its ends, a second end of said lever having a hook for engaging said second locking member and a first end of said lever being operatively associated with said manipulable means for controllably moving said first end of said lever between said first position and said second position.

4. The controllable locking apparatus of claim 1, wherein at said first position of said first and second locking members and said pin positioned in said openings and maintaining said swing frame against movement, said first and second locking members are prevented by said pin from being manipulated to said second position.

5. A controllable locking apparatus for a work vehicle having a support, an implement carrying swing frame connected to said support by a first pivot pin apparatus, and an elevatable boom connected to said swing frame by a second pivot pin apparatus, comprising:

a boom lock having a first locking member affixed to said swing frame and a second locking member affixed to said boom, said locking members being controllably moveable between a first position at which said boom is in a substantially vertical position and said locking members are engaged and maintaining said boom against movement and a second position at which said locking members are disengaged and said boom is free for movement;

a swing lock having a pin, a substantially vertical opening in said swing frame, and a substantially vertical opening in said support, said swing frame opening and said support opening being aligned with one another at a preselected location of said swing frame and said pin being insertable into said openings and maintaining said swing frame against movement; and a means for obstructing insertion of said pin in said openings at said second position of said locking members, said obstruction means being responsive to the positioning of said first locking member such that said obstruction means is spaced from said openings at said first position of said locking members allowing insertion of said pin into said openings and obstructs insertion of said pin in said openings at said second position of said locking members.

6. A controllable locking apparatus for a work vehicle having a support, an implement carrying swing frame connected to said support by a first pivot pin apparatus, and an elevatable boom connected to said swing frame by a second pivot pin apparatus, comprising:

a boom lock for locking said boom in a substantially vertical position and maintaining said boom against movement, said boom lock having a first locking member affixed to said swing frame and a second locking member affixed to said boom, said locking members being controllably moveable between a first position at which the boom is in a substantially vertical position and the locking members are engaged and maintaining said boom against movement and a second position at which the locking members are disengaged and said boom is free for movement;

a swing lock for locking said swing frame against side to side movement, said swing lock having a pin and an opening in said swing frame, said pin being insertable into said opening in said swing frame and maintaining said swing frame against movement; and a means for obstructing insertion of said pin in said opening in said swing frame at said second position of said locking members, said obstruction means being responsive to the positioning of said first blocking member such that said obstruction means is spaced from said opening in said swing frame at said first position of said locking members allowing insertion of said pin into said opening in said swing frame and obstructs insertion of said pin in said opening in said swing frame at said second position of said locking members.

7. A controllable locking apparatus for a work vehicle having a support, an implement carrying swing frame connected to said support by a first pivot pin apparatus, and an elevatable boom connected to said swing frame by a second pivot pin apparatus, comprising:

a boom lock for locking said boom in a substantially vertical position and maintaining said boom against movement, said boom lock having a first locking member affixed to said swing frame and a second locking member affixed to said boom, said locking members being controllably moveable between a first position at which the boom is in a substantially vertical position and the locking members are engaged and maintaining said boom against movement and a second position at which said locking members are disengaged and said boom is free for movement;

a swing lock for locking said swing frame against side to side movement, said swing lock having a pin and an opening in said support, said pin being insertable into said opening in said support and maintaining said swing frame against movement; and a means for obstructing insertion of said pin in said opening in said support at said second position of said locking members, said obstruction means being responsive to the positioning of said first locking member such that said obstruction means is spaced from said opening in said support at said first position of said locking members allowing insertion of said pin into said opening in said support and obstructs insertion of said pin in said opening in said support at said second position of said locking members.

* * * * *